US010378841B2

(12) United States Patent
Vickers et al.

(10) Patent No.: US 10,378,841 B2
(45) Date of Patent: Aug. 13, 2019

(54) DRUM MAGAZINE BOLT CATCH ACTUATOR

(71) Applicants: Benjamin Jeffrey Vickers, Portland, OR (US); Nathan Robert Crary, Portland, OR (US)

(72) Inventors: Benjamin Jeffrey Vickers, Portland, OR (US); Nathan Robert Crary, Portland, OR (US)

( * ) Notice: Subject to any disclaimer, the term of this patent is extended or adjusted under 35 U.S.C. 154(b) by 214 days.

(21) Appl. No.: 14/693,871

(22) Filed: Apr. 23, 2015

(65) Prior Publication Data

US 2016/0313079 A1 Oct. 27, 2016

(51) Int. Cl.
*F41A 9/75* (2006.01)

(52) U.S. Cl.
CPC ..... *F41A 9/75* (2013.01)

(58) Field of Classification Search
CPC ..... F41A 17/34; F41A 17/36; F41A 17/40; F41A 17/42; F41A 9/61; F41A 9/73; F41A 9/74; F41A 9/75
USPC ..... 42/49.01, 49.02, 70.02; 89/33.02, 137, 89/142, 148
See application file for complete search history.

(56) References Cited

U.S. PATENT DOCUMENTS 4,384,508 A * 5/1983 Sullivan ..... F41A 9/54 89/33.02
4,445,418 A * 5/1984 Sullivan ..... F41A 9/54 89/33.02
5,638,626 A * 6/1997 Westrom ..... F41A 9/70 42/18
8,898,946 B1 * 12/2014 Johnson ..... F41A 17/36 42/49.02
9,207,029 B2 * 12/2015 Klarborg ..... F41A 9/70
9,528,784 B2 * 12/2016 Roberts ..... F41A 9/75
2011/0107901 A1 * 5/2011 Lasichak ..... F41A 9/03 89/33.02
2011/0107902 A1 * 5/2011 Quetschke ..... F41A 9/75 89/33.02
2012/0005938 A1 * 1/2012 Sloan ..... F41G 1/40 42/113
2012/0311912 A1 * 12/2012 Howe ..... F41G 1/01 42/111
2014/0076137 A1 * 3/2014 Lasichak ..... F41A 9/70 89/33.02

(Continued)

FOREIGN PATENT DOCUMENTS

GB 2193797 B * 12/1989 ..... F41A 19/10

*Primary Examiner* — Jonathan C Weber

(57) ABSTRACT

The invention is an improvement to a typical firearm drum magazine cartridge feeding system. The improvement provides firearm drum magazine feeding systems with features that work together in tandem to actuate a typical firearm bolt catch. The firearm bolt catch is a common feature in many firearms with the purpose of halting the forward momentum of a firearm bolt. By actuating the firearm bolt catch, a firearm operator is aware that a drum magazine is empty of firearm cartridges. The advantage of this improvement is twofold. First, a firearm enthusiast or soldier utilizing a drum magazine with this improvement will enjoy the benefit of not taking an additional step to pull back a firearm bolt before reloading, and any person will enjoy the added safety benefit of knowing when a firearm is unloaded and safe to handle.

6 Claims, 21 Drawing Sheets

(56) References Cited

U.S. PATENT DOCUMENTS

| | | | | |
|---|---|---|---|---|
| 2015/0168103 | A1* | 6/2015 | Ilacqua | F41G 1/383<br>42/143 |
| 2015/0267981 | A1* | 9/2015 | Faughn | F41A 9/62<br>42/1.02 |
| 2016/0102931 | A1* | 4/2016 | Roberts | F41A 9/75<br>89/33.02 |
| 2017/0003092 | A1* | 1/2017 | Faughn | F41A 9/62 |
| 2018/0259282 | A1* | 9/2018 | Tolentino | F41A 17/36 |

* cited by examiner

DRUM MAGAZINE BOLT CATCH ACTUATOR

This application claims priority to provisional application No. 61/996,472 filed on May 9, 2014, which is hereby incorporated by reference in its priority.

FIELD OF THE INVENTION

The invention is directly related to firearms, and the feeding of non-linked cartridges in semi-automatic and automatic small arms. More particularly, the invention expands on high capacity drum magazines by including a feature with the function of actuating a firearm bolt catch.

BACKGROUND OF THE INVENTION

Firearms have made significant advancements since the discovery of gunpowder in the ninth century. Although early firearm technologies like the musket of the 1700 and early 1800s offered a person the ability to strike a target at distance, they did not offer great accuracy. Additionally, these firearm technologies lacked the ability to reload rapidly, risking a person's life in a battle. In other situations, like hunting for example, many game opportunities were lost because of a slow reloading time. Thus, the search for a faster reload time and greater accuracy ensued.

By the mid 1800s, a single barreled "repeating rifle" with cartridges was developed. This technology offered a person reduced reload time with the incorporation of a lever, and greater accuracy by using cartridges. Box magazines were developed with the function of housing multiple cartridges providing a person with multiple rounds before reloading. These early box magazines held the cartridges in a vertical stack above, below or in a horizontal stack to the side of the firearm. In other words, the cartridges sit one on top of another, pushed up by a spring, in a single file. To incorporate additional rounds in these types of box magazines necessitated a longer box magazine. Eventually, these box magazines can become too long to the point of becoming cumbersome.

Drum magazines were developed in part to provide a greater cartridge capacity for a firearm while staying within a more compact area in relationship to the firearm. Drum magazines house cartridges in round or curved housings with a tension spring that pushed the cartridges around a curved track into a firearm chamber. The amount of cartridges housed within the drum magazine can be increased substantially while keeping a more compact profile.

Many firearms today incorporate a feature typically referred to as a bolt catch. The bolt catch is an apparatus that prevents or "catches" a firearm bolt from moving forward in a firearm chamber. The bolt catch is automatically pushed into the firearm chamber, after a final cartridge is discharged, by a spring loaded feeder incorporated in a typical box magazine. When a firearm operator reloads the firearm with a fully loaded box magazine, typically the firearm operator will manually actuate the bolt catch to allow the bolt to move forward into chamber.

Drum magazines used with a firearm that includes a bolt catch do not have the ability to actuate the bolt catch. Thus, when a final cartridge is discharged from a firearm, a firearm bolt will still move forward within a firearm chamber. During times when reloading rapidly with drum magazines is essential, having to pull the firearm bolt back manually before reloading another drum magazine puts an unnecessary and inconvenient burden on a person. Additionally, any person would not know whether a firearm is loaded or not loaded after discharging any amount of rounds from a drum magazine. Both of the above mentioned issues are safety concerns and need to be addressed.

Therefore, there is a need to incorporate a bolt catch actuator within a drum magazine. This feature will provide any person with the convenience of more rapid reloading as well as the added safety benefits of knowing when a firearm is loaded or not loaded.

SUMMARY OF THE INVENTION

An embodiment of the present invention includes an improvement to a typical firearm drum magazine cartridge feeding system. It is designed to improve firearm drum magazine feeding systems by introducing features that work together to actuate a firearm bolt catch integrated with semi-automatic and automatic firearms. The advantage of this improvement is twofold. First, a firearm enthusiast or soldier utilizing a drum magazine with this improvement will enjoy the benefit of not taking an additional step to pull back a firearm bolt before reloading, and any person will enjoy the added safety benefit of knowing when a firearm is unloaded and safe to handle.

BRIEF DESCRIPTION OF DRAWINGS

The present invention will become more fully understood from the detailed description and the accompanying drawings, wherein.

DETAILED DESCRIPTION OF THE PREFERRED EMBODIMENTS

Figure 1:
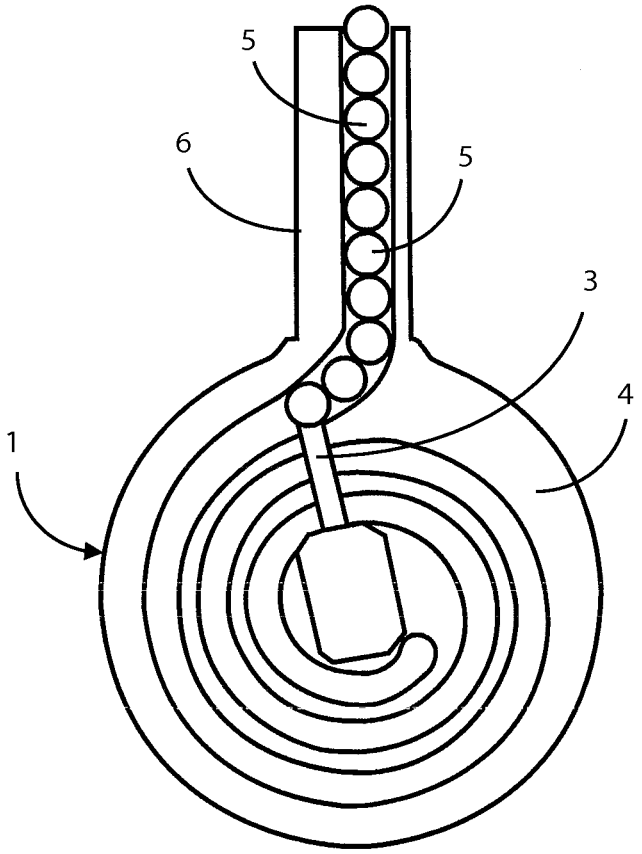
FIG. 1 is a front inside view of a spring body section 1 of a typical drum magazine used for loading ammunition into firearms.

FIG. 1 is a front inside view of a spring body section 1 of a typical drum magazine used for loading ammunition into firearms. The spring body section 1 may be attachable to a channel body section 2 with screws, bolts, studs, snap-fits or by another means that provides a compression or holding force between the spring body section 1 and the channel body section 2. In the preferred embodiment, the drum magazine, as related to the present invention, is designed for a repeating rifle. Other embodiments may include drum magazines, as related to the present invention, designed for any type of firearm capable of utilizing a drum magazine. In the present invention, the drum magazine in the preferred embodiment contains a "clock" or "spiral" spring arm 3 contained within a main drum magazine body 4. The spring arm 3 forces a multitude of magazine followers 5 upward and into a drum magazine neck 6. In other embodiments another type of spring may be integrated into the drum magazine that which may provide the same function. Other embodiments may include another method of forcing a multitude of magazine followers upward and into the drum magazine neck and still remain within the scope of the present invention.

Figure 2:
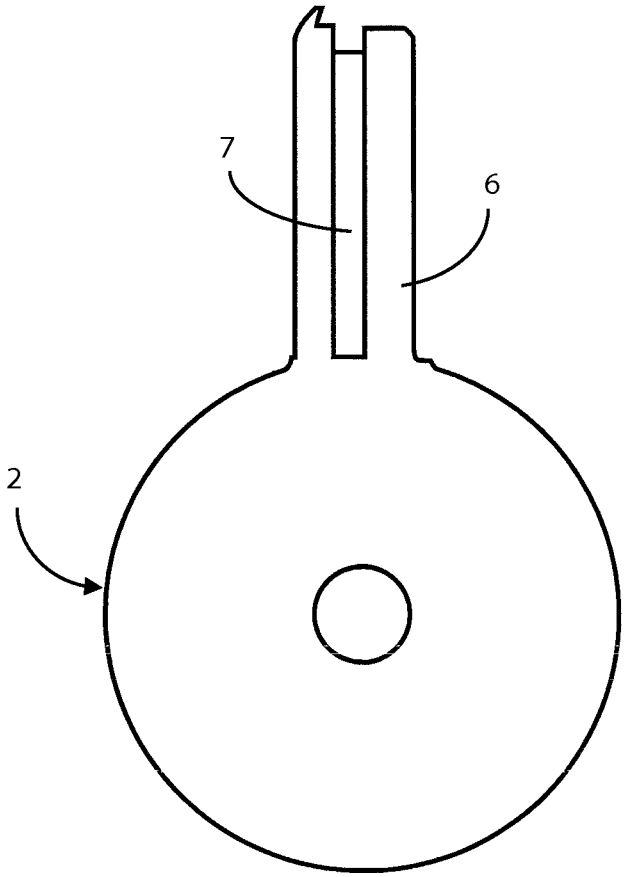
FIG. 2 is a front outside view of a channel body section 2 of a typical drum magazine, with a drum magazine neck slide 7 shown.

FIG. 2 is a front outside view of a channel body section 2 of a typical drum magazine, with a drum magazine neck slide 7 shown. The channel body section 2 may be attachable to a spring body section 1 with screws, bolts, studs, snap-fits or by another means that provides a compression or holding force between the spring body section 1 and the channel body section 2. The drum magazine neck slide 7 is integrated onto the outside of the drum magazine neck 6. The drum magazine neck slide 7 guides the drum magazine neck 6 into a magazine well of a firearm.

Figure 3:
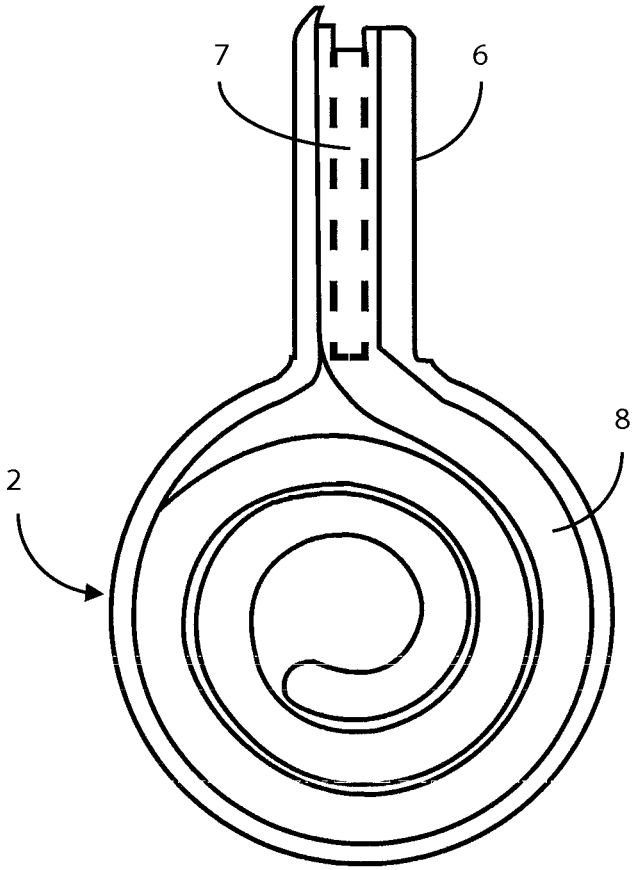
FIG. 3 is a front inside view of a channel body section 2 of a typical drum magazine, with a drum magazine neck slide 7 shown in dotted lines.

FIG. 3 is a front inside view of a channel body section 2 of a typical drum magazine, with the drum magazine neck slide 7 shown in dotted lines. A drum magazine channel 8 guides the multitude of magazine followers 5 upward and into the drum magazine neck 6.

Figure 4:
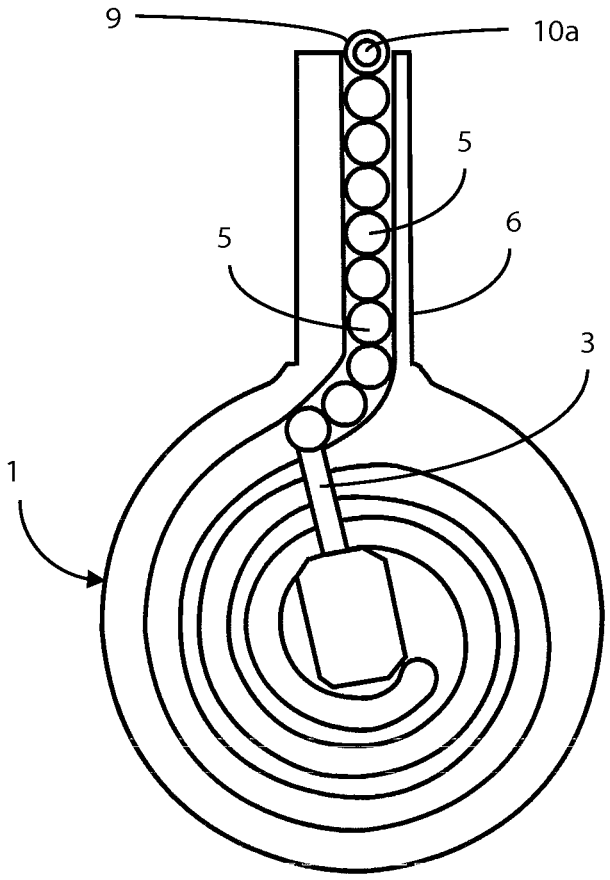
FIG. 4 is a first embodiment front inside view of a spring body section 1 of a typical drum magazine used for loading ammunition into firearms.

FIG. 4 is a first embodiment front inside view of a spring body section 1 of a typical drum magazine used for loading ammunition into firearms. Here, a multitude of magazine followers 5 are led by a main magazine follower 9 comprised of a main magazine follower engagement member 10*a*. In this embodiment, the main magazine follower 9 leads the multitude of magazine followers 5, and makes direct contact with a final ammunition round loaded into the drum magazine. The multitude of magazine followers 5 and main magazine follower 9 are forced into a drum magazine neck 6 by a spring arm 3. In this embodiment the main magazine follower engagement member 10*a* is a magnetic material that engages with a bolt catch actuator engagement face 12 on a bolt catch actuator 11. In this embodiment, the bolt catch actuator engagement face 12 includes an engagement segment 13*a* made of a magnetic material. The main magazine follower engagement member 10*a* magnetically engages with the engagement segment 13*a* of the bolt catch actuator engagement face 12 when the spring arm 3 forces the multitude of magazine followers 5 into the drum magazine neck 6. In this embodiment, the main magazine follower engagement member 10*a* and the engagement segment 13*a* may be of any type of material capable of producing or being induced with a magnetic field including, but not limited to, typical ferromagnetic, paramagnetic and diamagnetic materials. Additionally, the bolt catch actuator engagement face 12 may be comprised of any of these types of magnetic material. Likewise, the bolt catch actuator 11 may be comprised of any of these types of material. In other embodiments, the main magazine follower 9 comprised of the main magazine follower engagement member 10*a* may be any magazine follower linked to the multitude of magazine followers 5, other than a magazine follower in direct contact with a final ammunition round contained within the drum magazine. In these embodiments, the magazine follower in direct contact with the final ammunition round is considered one of the multitude of magazine followers 5, whereas another magazine follower with the main magazine follower engagement member 10*a*, is referred to as the main magazine follower 9.

Figure 5:
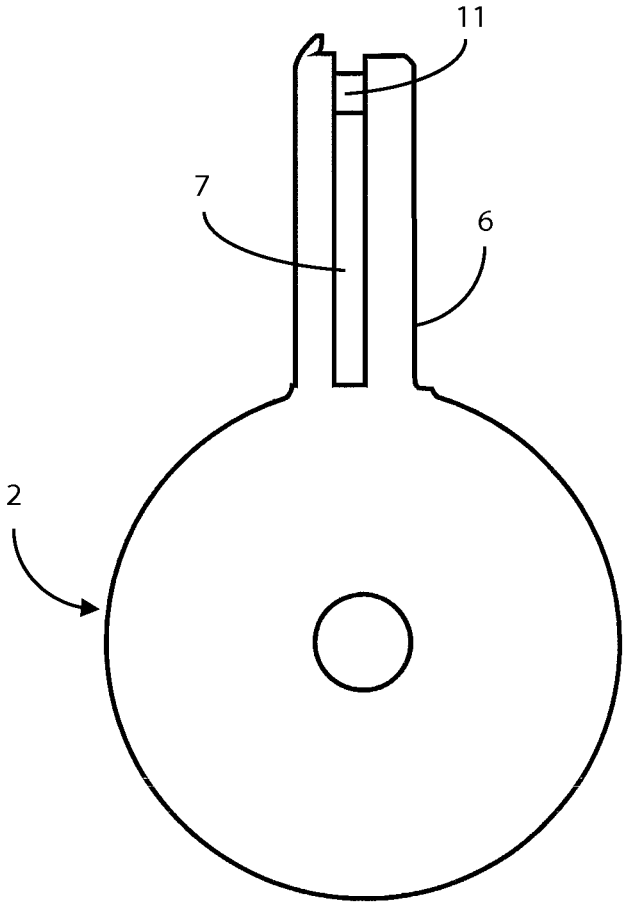
FIG. 5 is a first embodiment front outside view of the channel body section 2 of a typical drum magazine, with a drum magazine neck slide 7 shown.

FIG. 5 is a first embodiment front outside view of a channel body section 2 of a typical drum magazine, with a drum magazine neck slide 7 shown. The drum magazine neck slide 7 is integrated onto the outside of the drum magazine neck 6. The drum magazine neck slide 7 guides the drum magazine neck 6 into a magazine well of a firearm. In this embodiment, the bolt catch actuator 11 is slidably disposed within the drum magazine neck slide 7. The bolt catch actuator 11 is shown here in a resting position. The bolt catch actuator 11 is a mechanically separate piece from the drum magazine neck slide 7.

Figure 6:
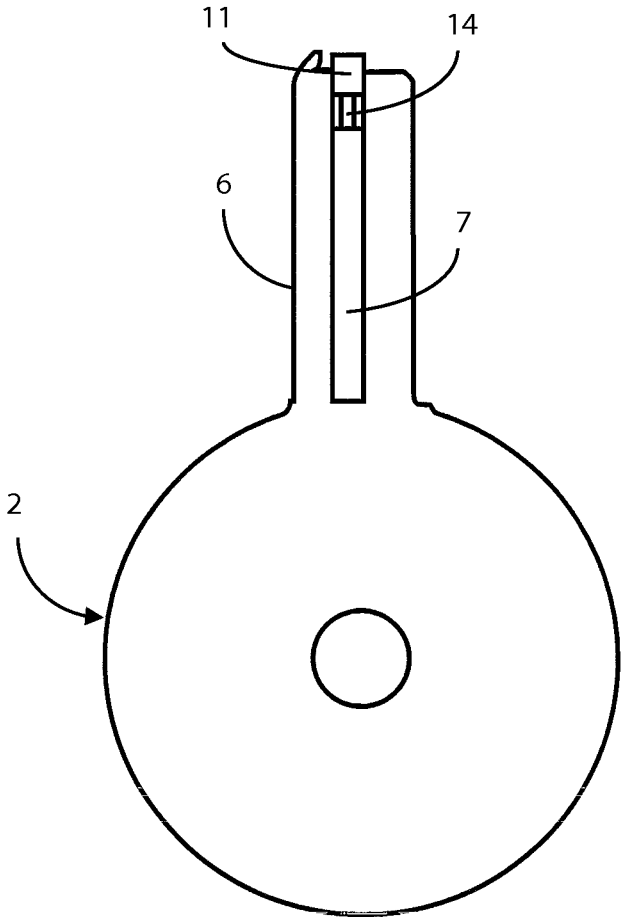
FIG. 6 is a first embodiment front outside view of the channel body section 2 of a typical drum magazine, with the drum magazine neck slide 7 shown.

FIG. 6 is the first embodiment front outside view of the channel body section 2 of a typical drum magazine, with the drum magazine neck slide 7 shown. The drum magazine neck slide 7 is integrated onto the outside of the drum magazine neck 6. The drum magazine neck slide 7 guides the drum magazine neck 6 into a magazine well of a firearm. In this embodiment, the bolt catch actuator 11 is slidably disposed within the drum magazine neck slide 7. The bolt catch actuator 11 is shown here in an extended position with a bolt catch actuator arm 14 shown. Here, the bolt catch actuator 11 is mechanically separate from the drum magazine neck slide 7.

Figure 7:
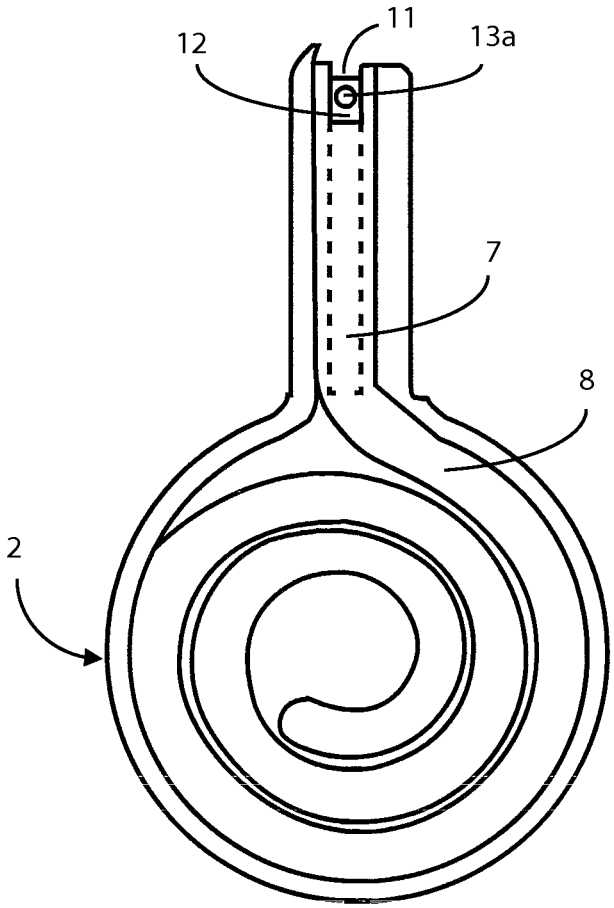
FIG. 7 is a first embodiment front inside view of a channel body section 2 of a typical drum magazine, with the drum magazine neck slide 7 shown in dotted lines.

FIG. 7 is a first embodiment front inside view of a channel body section 2 of a typical drum magazine, with the drum magazine neck slide 7 shown in dotted lines. A drum magazine channel 8 guides the multitude of magazine followers 5 upward and into the drum magazine neck 6. In this embodiment, the bolt catch actuator 11 is slidably disposed within the drum magazine neck slide 7. The bolt catch actuator 11 is shown here in a resting position. The bolt catch actuator 11 is mechanically separate from the drum magazine neck slide 7. The bolt catch actuator 11 is integrated with the bolt catch actuator engagement face 12. In this embodiment, the bolt catch actuator engagement face 12 includes the engagement segment 13*a* that includes magnetic properties. The magnet may be of any type of material capable of producing or being induced with a magnetic field including, but not limited to, typical ferromagnetic, paramagnetic and diamagnetic materials. The magnet may be of any size and shape capable of fitting within the spatial constraints of the bolt catch actuator 11. The magnet may be of any size and shape capable of magnetically engaging with the main magazine follower engagement member 10*a* and providing adequate force to move the bolt catch actuator 11 toward a firearm bolt catch 20.

Figure 8:
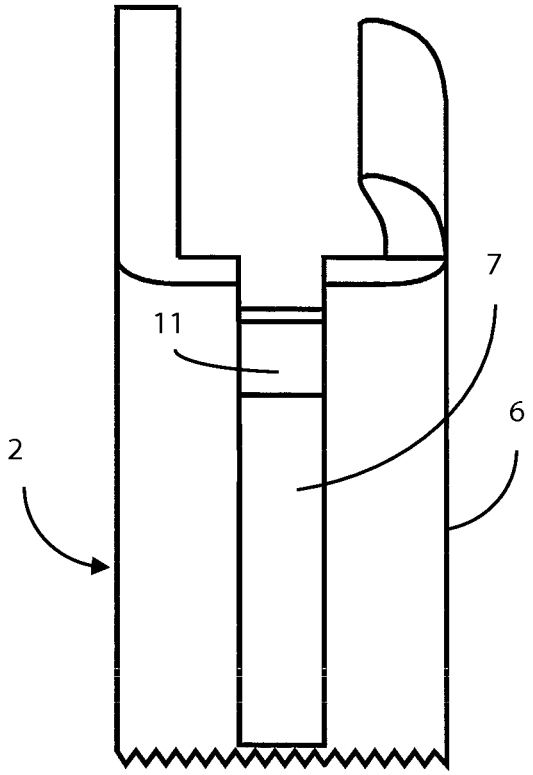
FIG. 8 is a first embodiment outside perspective view of the drum magazine neck 6 of the channel body section 2, of a typical drum magazine.

FIG. 8 is a first embodiment outside perspective view of the drum magazine neck 6 of the channel body section 2, of a typical drum magazine. In this embodiment, the bolt catch actuator 11 is slidably disposed within the drum magazine neck slide 7. The bolt catch actuator 11 is shown here in a resting position. The bolt catch actuator 11 is mechanically separate from the drum magazine neck slide 7. Ammunition rounds are fed along the drum magazine channel 8 by a force induced by the spring arm 3. When the last round is discharged, the main magazine follower 9, which is comprised of the main magazine follower engagement member 10*a*, moves across the bolt catch actuator engagement face 12 and the engagement segment 13*a*. The main magazine follower 9 and bolt catch actuator 11 magnetically engage causing the bolt catch actuator 11 to move toward the firearm bolt catch 20.

Figure 9:
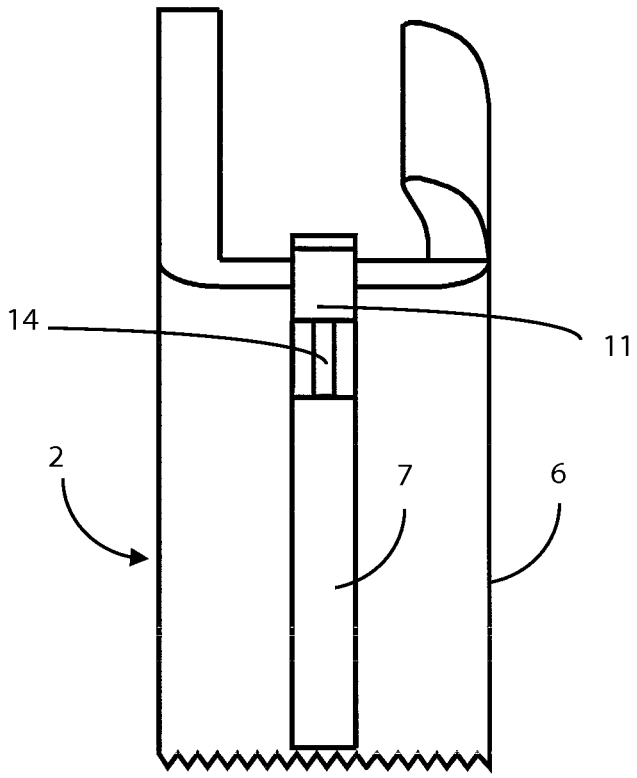
FIG. 9 is a first embodiment outside perspective view of the drum magazine neck 6 of the channel body section 2, of a typical drum magazine.

FIG. 9 is the first embodiment outside perspective view of the drum magazine neck 6 of the channel body section 2, of a typical drum magazine. In this embodiment, the bolt catch actuator 11 is slidably disposed within the drum magazine neck slide 7. The bolt catch actuator 11 is shown here in an extended position with the bolt catch actuator arm 14 showing. The bolt catch actuator 11 is mechanically separate from the drum magazine neck slide 7. Ammunition rounds are fed along the drum magazine channel 8 by a force induced by the spring arm 3. When the last round is discharged, the main magazine follower 9, which is comprised of the main magazine follower engagement member 10*a*, moves across the bolt catch actuator engagement face 12 and the engagement segment 13*a*. The main magazine follower 9 and bolt catch actuator 11 magnetically engage causing the bolt catch actuator 11 to move toward the firearm bolt catch 20.

Figure 10:
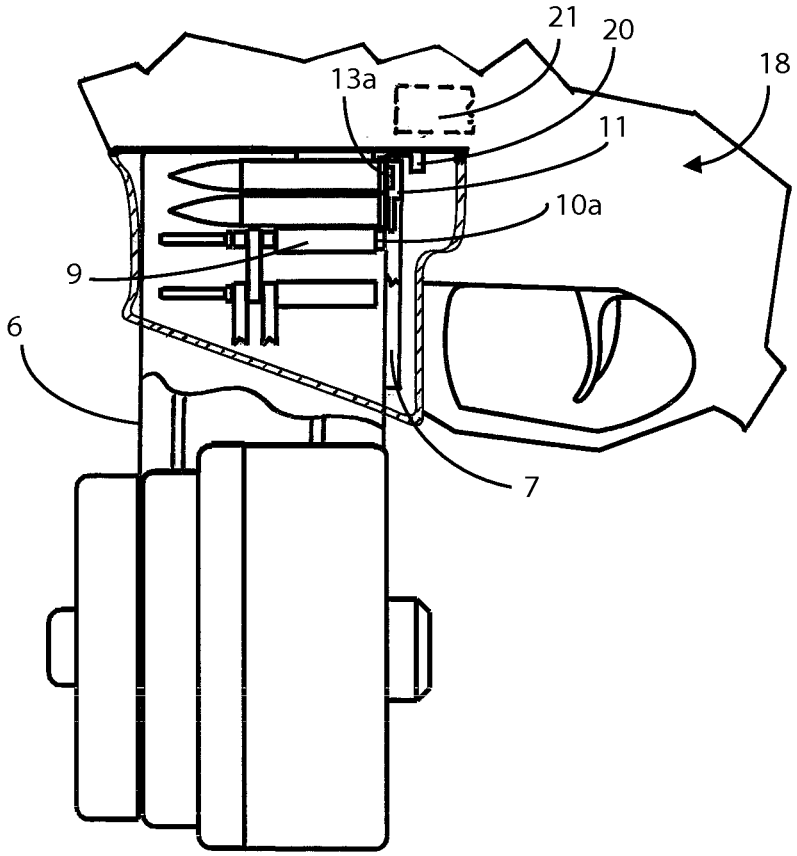
FIG. 10 is a first embodiment side view of a typical drum magazine and the drum magazine neck 6 inserted into a typical firearm 18.

FIG. 10 is a first embodiment side view of a typical drum magazine and the drum magazine neck 6 inserted into a firearm 18. In this embodiment the bolt catch actuator 11 is slidably disposed within the drum magazine neck slide 7. The bolt catch actuator 11 is shown here in a resting position, before the main magazine follower 9 and the main magazine follower engagement member 10*a*, move across the bolt catch actuator engagement face 12 and the engagement segment 13*a*. The main magazine follower 9 and the bolt catch actuator 11 magnetically engage causing the bolt catch actuator 11 to move toward the firearm bolt catch 20 which halts the forward momentum of a firearm bolt 21, housed within the firearm 18.

Figure 11:
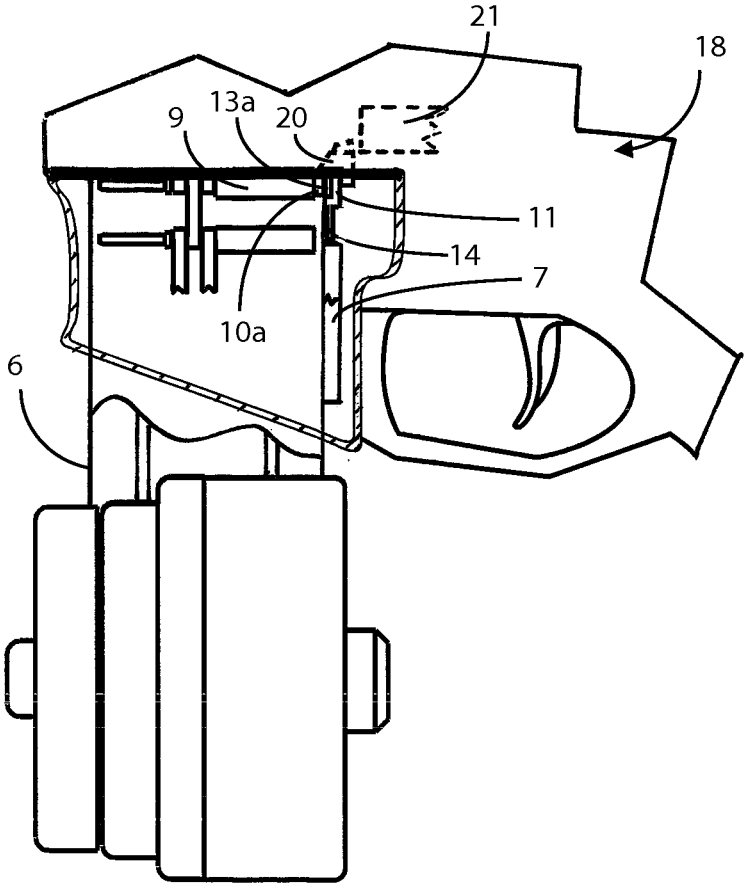
FIG. 11 is a first embodiment side view of a typical drum magazine and the drum magazine neck 6 inserted into a typical firearm 18.

FIG. 11 is the first embodiment side view of a typical drum magazine and the drum magazine neck 6 inserted into a typical firearm 18. In this embodiment the bolt catch actuator 11 is slidably disposed within the drum magazine neck slide 7. The bolt catch actuator 11 is shown here in an extended position with the bolt catch actuator arm 14 shown, after the main magazine follower 9 and the main magazine follower engagement member 10*a*, move across the bolt catch actuator engagement face 12 and the engagement segment 13*a*. The main magazine follower 9 and bolt catch actuator 11 magnetically engage causing the bolt catch actuator 11 to move toward the firearm bolt catch 20 which halts the forward momentum of the firearm bolt 21, housed within the firearm 18.

Figure 12:
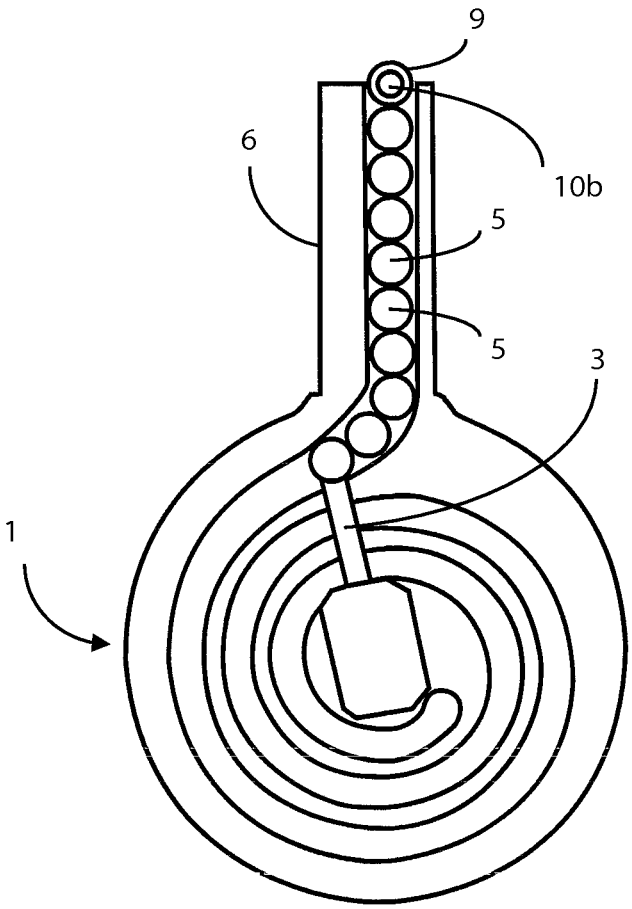
FIG. 12 is a second embodiment front inside view of the spring body section 1 of a typical drum magazine used for loading ammunition into firearms.

FIG. 12 is a second embodiment front inside view of a spring body section 1 of a typical drum magazine used for loading ammunition into firearms. Here, a multitude of magazine followers 5 are led by a main magazine follower 9 comprised of a main magazine follower engagement member 10*b*. The multitude of magazine followers 5 and the main magazine follower 9 are forced into the drum magazine neck 6 by a spring arm 3. In this embodiment the main magazine follower engagement member 10*b* is a ball bearing attached to a spring 16 that engages with an engagement segment 13*b* of a bolt catch actuator engagement face 12. Also in this embodiment, the engagement segment 13*b* of the bolt catch actuator engagement face 12 is a recessed channel shaped to engage with the main magazine follower engagement member 10*b*. The main magazine follower engagement member 10*b* mechanically engages with the bolt catch actuator engagement face 12 when the spring arm 3 forces the multitude of magazine followers 5 into the drum magazine neck 6. In this embodiment, both the main magazine follower engagement member 10*b* and the bolt catch actuator engagement face 12 may be of any shape or material which provides a strong, temporary linkage between the main magazine follower engagement member 10*b* and the bolt catch actuator engagement face 12. In other embodiments, the main magazine follower engagement member 10*b* may be a solid piece or solid pieces that are not spherical in shape, whilst still providing the same function of mechanically linking with the bolt catch actuator engagement face 12. In other embodiments, the main magazine follower engagement member 10*b* may be a solid piece molded or shaped into the main magazine follower 9, whilst still providing the same function of mechanically linking with the bolt catch actuator engagement face 12. In these embodiments, the engagement segment 13*b* may be a lever, flange, fin or other component integrated or molded onto the bolt catch actuator engagement face 12.

Figure 13:
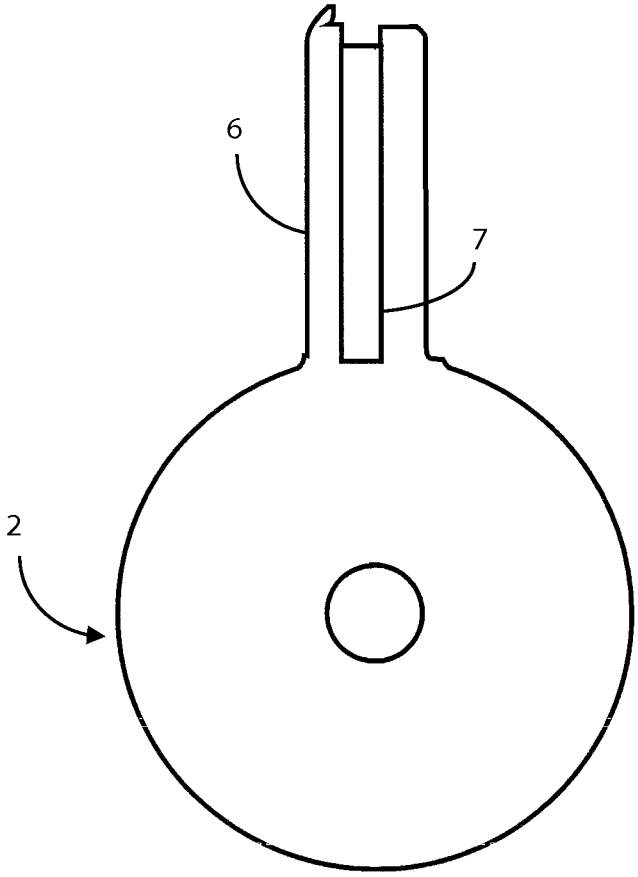
FIG. 13 is a second embodiment front outside view of the channel body section 2 of a typical drum magazine, with the neck slide 7 shown.

FIG. 13 is a second embodiment front outside view of a channel body section 2 of a typical drum magazine, with a neck slide 7 shown. The drum magazine neck slide 7 is integrated onto the outside of the drum magazine neck 6. The drum magazine neck slide 7 guides the drum magazine neck 6 into a magazine well of a firearm. In this embodiment, a bolt catch actuator 11 is slidably disposed within the drum magazine neck slide 7.

Figure 14:
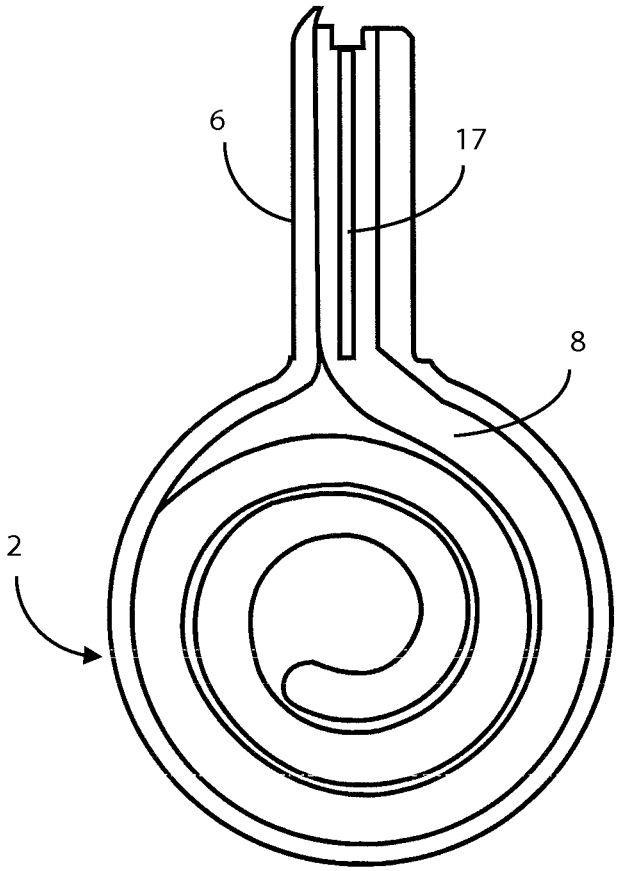
FIG. 14 is a second embodiment front inside view of the channel body section 2 of a typical drum magazine.

FIG. 14 is a second embodiment front inside view of the channel body section 2 of a typical drum magazine. A drum magazine channel 8 guides the multitude of magazine followers 5 upward and into the drum magazine neck 6. In this embodiment, an engagement channel 17 provides a path for the main magazine follower engagement member 10*b* to slide into the engagement segment 13*b* on the bolt catch actuator engagement face 12.

Figure 15:
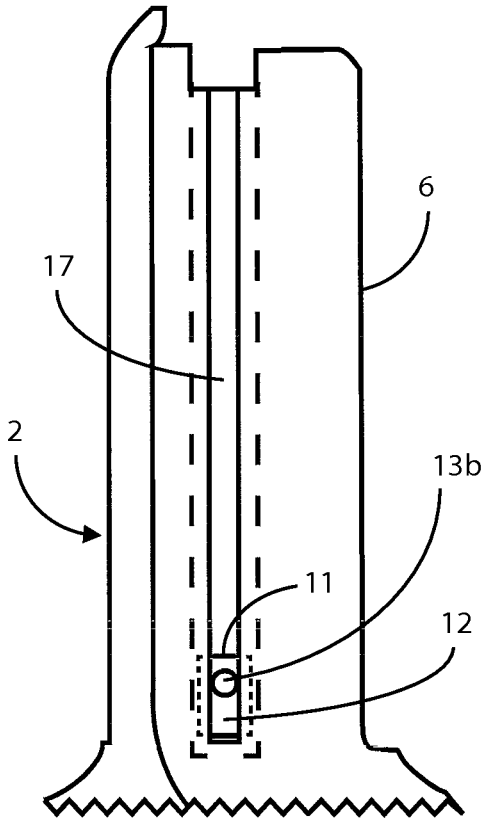
FIG. 15 is a second embodiment front inside close-up view of the channel body section 2 of a typical drum magazine.

FIG. 15 is a second embodiment front inside close-up view of the channel body section 2 of a typical drum magazine. The drum magazine channel 8 guides the multitude of magazine followers 5 upward and into the drum magazine neck 6. In this embodiment, the engagement channel 17 provides a path for the main magazine follower engagement member 10*b* to slide into the engagement segment 13*b* on the bolt catch actuator engagement face 12. In this embodiment, the bolt catch actuator 11 is in the resting position. The bolt catch actuator engagement face 12 is exposed in the engagement channel 17.

Figure 16:
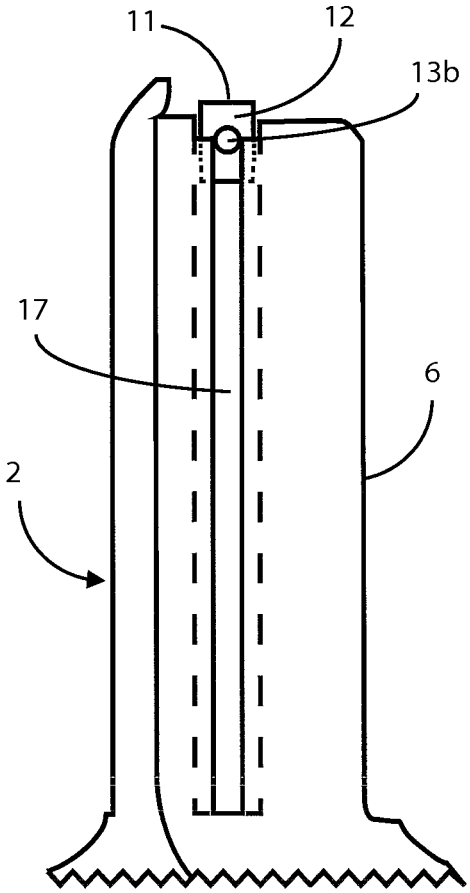
FIG. 16 is a second embodiment front inside close-up view of the channel body section 2, of a typical drum magazine.

FIG. 16 is the second embodiment front inside close-up view of the channel body section 2 of a typical drum magazine. The drum magazine channel 8 guides the multitude of magazine followers 5 upward and into the drum magazine neck 6. In this embodiment, the engagement channel 17 provides a path for the main magazine follower engagement member 10*b* to slide into the engagement segment 13*b* on the bolt catch actuator engagement face 12. In this embodiment, the bolt catch actuator 11 is in the extended position. The bolt catch actuator engagement face 12 is exposed in the engagement channel 17.

Figure 17:
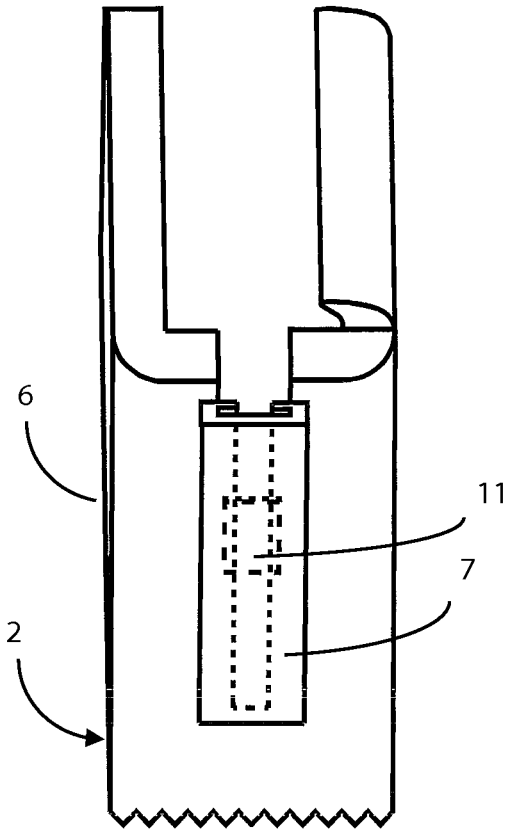
FIG. 17 is a second embodiment outside perspective view of the drum magazine neck 6 of the channel body section 2, of a typical drum magazine.

FIG. 17 is a second embodiment outside perspective view of the drum magazine neck 6 of the channel body section 2, of a typical drum magazine. In this embodiment, the bolt catch actuator 11 is slidably disposed within the drum magazine neck slide 7. The bolt catch actuator 11 is shown here in a middle position. The bolt catch actuator 11 is mechanically separate from the drum magazine neck slide 7. Ammunition rounds are fed along the drum magazine channel 8 by a force induced by the spring arm 3. When the last round is discharged, the main magazine follower 9, which is comprised of the main magazine follower engagement member 10*b*, moves across the bolt catch actuator engagement face 12 and the engagement segment 13*b*. The main magazine follower 9 and the bolt catch actuator 11 mechanically engage causing the bolt catch actuator 11 to move toward the firearm bolt catch 20.

Figure 18:
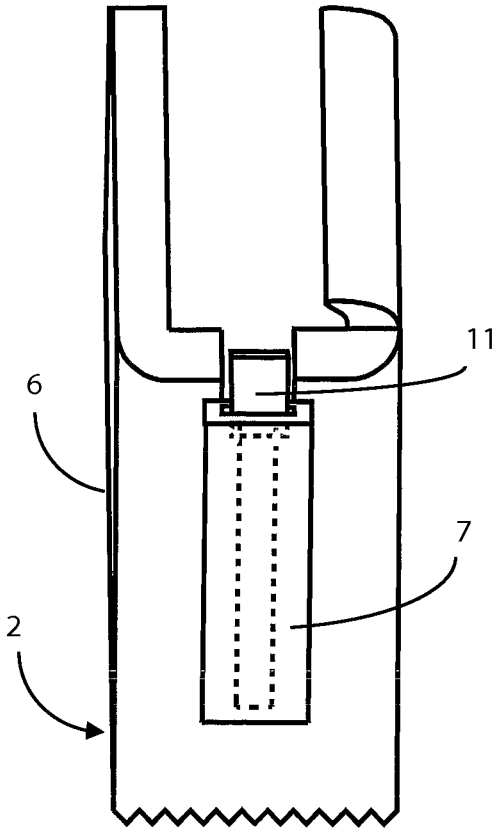
FIG. 18 is a second embodiment outside perspective view of the drum magazine neck 6 of the channel body section 2, of a typical drum magazine.

FIG. 18 is the second embodiment outside perspective view of the drum magazine neck 6 of the channel body section 2, of a typical drum magazine. In this embodiment, the bolt catch actuator 11 is slidably disposed within the drum magazine neck slide 7. The bolt catch actuator 11 is shown here in the extended position. The bolt catch actuator 11 is mechanically separate from the drum magazine neck slide 7. Ammunition rounds are fed along the drum magazine channel 8 by a force induced by the spring arm 3. When the last round is discharged, the main magazine follower 9, which is comprised of the main magazine follower engagement member 10*b*, moves across the bolt catch actuator engagement face 12 and the engagement segment 13*b*. The main magazine follower 9 and the bolt catch actuator 11 mechanically engage causing the bolt catch actuator 11 to move toward the firearm bolt catch 20.

Figure 19:
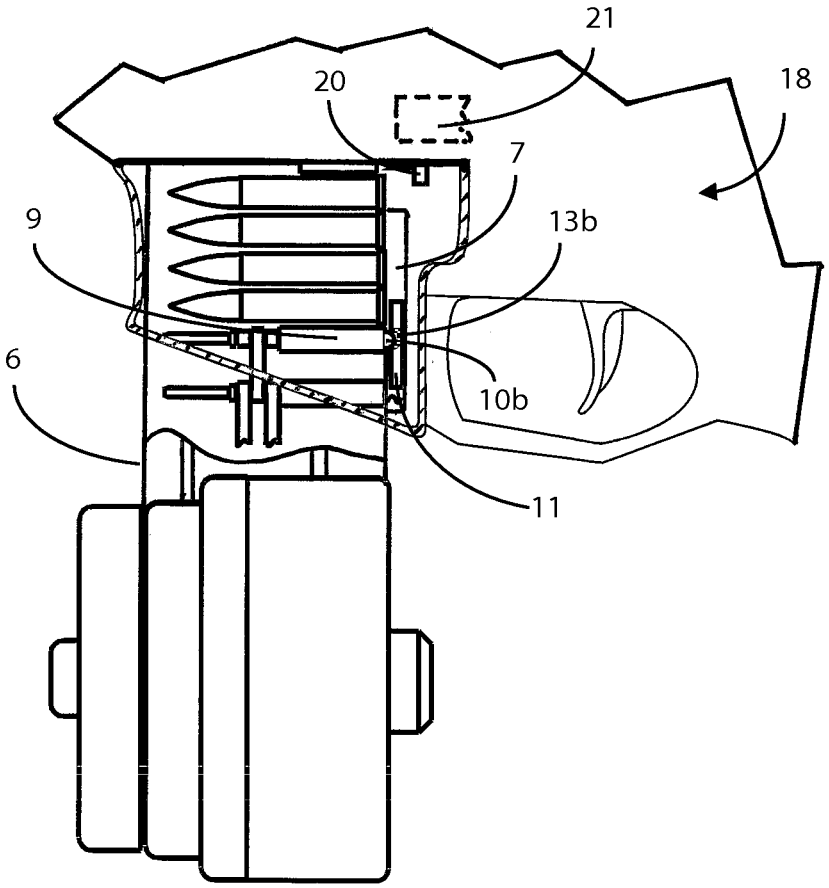
FIG. 19 is a second embodiment side view of the drum magazine and the drum magazine neck 6 inserted into a typical firearm 18.

FIG. 19 is a second embodiment side view of the drum magazine and the drum magazine neck 6 inserted into a firearm 18. In this embodiment the bolt catch actuator 11 is slidably disposed within the drum magazine neck slide 7. The bolt catch actuator 11 is shown here in a resting position, before the main magazine follower 9 and the main magazine follower engagement member 10*b*, move across the bolt catch actuator engagement face 12 and the engagement segment 13*b*. The main magazine follower 9 and bolt catch actuator 11 mechanically engage causing the bolt catch actuator 11 to move toward the firearm bolt catch 20 which halts the forward momentum of a firearm bolt 21, housed within the firearm 18.

Figure 20:
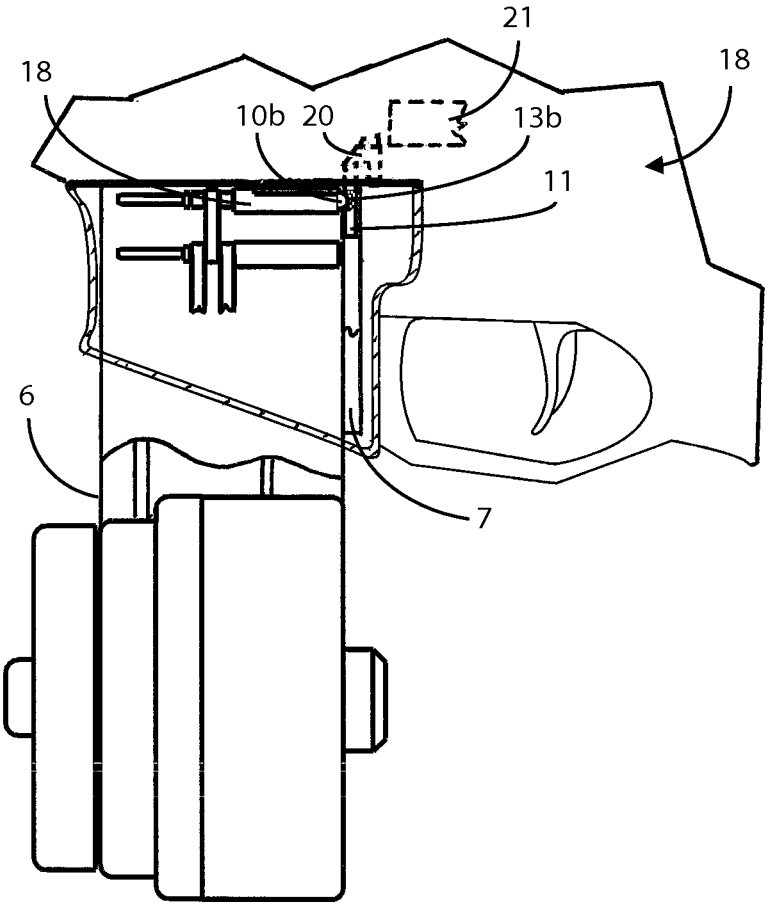
FIG. 20 is a second embodiment side view of the drum magazine and the drum magazine neck 6 inserted into a typical firearm 18.

FIG. 20 is the second embodiment side view of the drum magazine and the drum magazine neck 6 inserted into a firearm 18. In this embodiment the bolt catch actuator 11 is slidably disposed within the drum magazine neck slide 7. The bolt catch actuator 11 is shown here in an extended position, after the main magazine follower 9 and the main magazine follower engagement member 10*b*, move across the bolt catch actuator engagement face 12 and the engagement segment 13*b*. The main magazine follower 9 and bolt catch actuator 11 mechanically engage causing the bolt catch actuator 11 to move toward the firearm bolt catch 20 which halts the forward momentum of the firearm bolt 21, housed within the firearm 18.

Figure 21A:
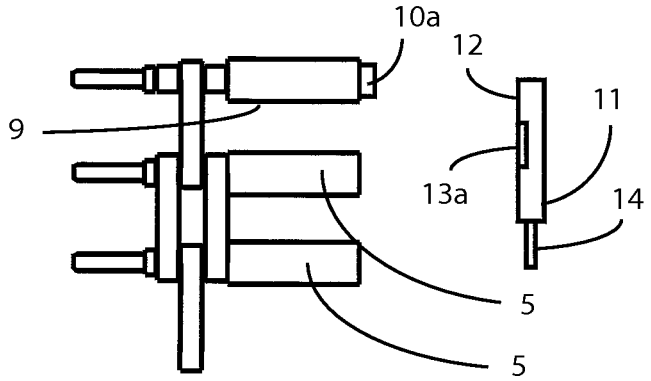
FIGS. 21A and 21B are piece-part side views of the first and second embodiments of the bolt catch actuator 11 and their associated modes of action.
Figure 21B:
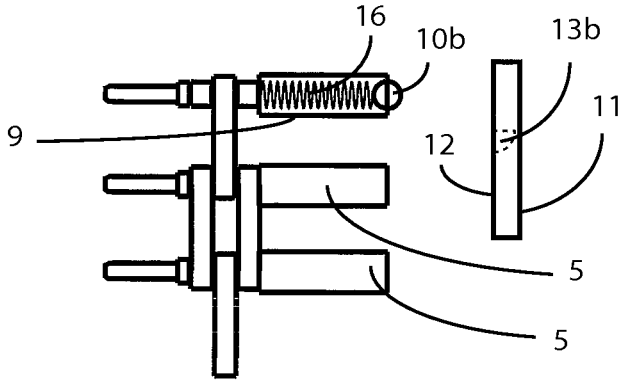

FIGS. 21A and 21B are piece-part side views of the first and second embodiments of the bolt catch actuator 11 and their associated modes of action. The first embodiment 21A shows the main magazine follower 9 and the main magazine follower engagement member 10*a* attached to the multitude of magazine followers 5. The main magazine follower engagement member 10 is made of magnetic material that engages with the engagement segment 13*a* of the bolt catch actuator engagement face 12 on the bolt catch actuator 11. In the second embodiment 21B, the main magazine follower 9 and the main magazine follower engagement member 10*b* are attached to the multitude of magazine followers 5. The spring 16 forces the main magazine follower engagement member 10*b* into the engagement segment 13*b* of the bolt catch actuator engagement face 12 on the bolt catch actuator 11.

What is claimed is:

1. A drum magazine bolt catch actuator system for use with a firearm, comprising:

A drum magazine;

A drum magazine neck slide protruding from a drum magazine neck;

A bolt catch actuator slidably disposed about the drum magazine neck slide;

A bolt catch actuator engagement face consisting of magnetic material integrated with the bold catch actuator;

A main magazine follower;

The main magazine follower attached to a multitude of magazine followers driven by a rotational drum magazine body spring;

The main magazine follower comprised of a main magazine follower engagement member consisting of magnetic material;

whereby the main magazine follower moves across the bolt catch actuator engagement face such that the main magazine follower engagement member magnetically links with the bolt catch actuator engagement face to move the bolt catch actuator toward a firearm bolt catch, the bolt catch actuator contacting and moving the firearm bolt catch to interact with a firearm bolt.

2. The drum magazine bolt catch actuator system according to claim 1, wherein the bolt catch actuator engagement face and main magazine follower engagement member comprise magnetic materials with opposite polarities.

3. The drum magazine bolt catch actuator system according to claim 1, wherein the rotational drum magazine body spring forces the main magazine follower and main magazine follower engagement member within proximity to the bolt catch actuator engagement face.

4. The drum magazine bolt catch actuator system according to claim 1, wherein the magnetic material of the bolt catch actuator engagement face may include any type of ferromagnetic, paramagnetic or diamagnetic material.

5. The drum magazine bolt catch actuator system according to claim 1, wherein the magnetic material of the main magazine follower engagement member may include any type of ferromagnetic, paramagnetic or diamagnetic material.

6. The drum magazine bolt catch actuator system according to claim 2, wherein the magnetic material of the bolt catch actuator engagement face and main magazine follower engagement member may include any type of ferromagnetic, paramagnetic or diamagnetic material.

* * * * *